US008893670B2

(12) United States Patent
Kosuge et al.

(10) Patent No.: US 8,893,670 B2
(45) Date of Patent: Nov. 25, 2014

(54) GAS COMBUSTION TYPE DRIVING TOOL

(75) Inventors: Makoto Kosuge, Tokyo (JP); Yasushi Yokochi, Tokyo (JP); Takamichi Hoshino, Tokyo (JP)

(73) Assignee: Max Co., Ltd., Tokyo (JP)

( * ) Notice: Subject to any disclaimer, the term of this patent is extended or adjusted under 35 U.S.C. 154(b) by 294 days.

(21) Appl. No.: 13/408,112

(22) Filed: Feb. 29, 2012

(65) Prior Publication Data

US 2012/0222654 A1 Sep. 6, 2012

(30) Foreign Application Priority Data

Mar. 2, 2011 (JP) ..... 2011-045222

(51) Int. Cl.
*B25C 1/08* (2006.01)

(52) U.S. Cl.
CPC ..... *B25C 1/08* (2013.01)
USPC ..... 123/46 H; 123/46 SC; 227/91; 227/10

(58) Field of Classification Search
CPC ..... B25C 1/08; B25C 1/10; B25C 1/123
USPC ..... 123/46 H, 46 SC; 227/9, 10
See application file for complete search history.

(56) References Cited

U.S. PATENT DOCUMENTS

| | | | | |
|---|---|---|---|---|
| 4,483,474 | A * | 11/1984 | Nikolich | 227/8 |
| 5,263,439 | A * | 11/1993 | Doherty et al. | 123/46 SC |
| 6,019,072 | A * | 2/2000 | Phillips et al. | 123/46 H |
| 7,546,938 | B2 * | 6/2009 | Panasik et al. | 227/10 |
| 2003/0116605 | A1 * | 6/2003 | Rosenbaum | 227/130 |
| 2006/0102111 | A1 * | 5/2006 | Ohmori et al. | 123/46 H |
| 2011/0180582 | A1 * | 7/2011 | Cordeiro et al. | 227/9 |
| 2012/0118932 | A1 * | 5/2012 | Largo et al. | 227/8 |
| 2013/0134204 | A1 * | 5/2013 | Morioka et al. | 227/9 |
| 2013/0320061 | A1 * | 12/2013 | AIHARA et al. | 227/9 |

FOREIGN PATENT DOCUMENTS

| | | |
|---|---|---|
| JP | A-S51-72784 | 6/1976 |
| JP | A-2009-297839 | 12/2009 |

* cited by examiner

*Primary Examiner* — Erick Solis
(74) *Attorney, Agent, or Firm* — Drinker Biddle & Reath LLP

(57) ABSTRACT

A gas combustion type driving tool is provided with a combustion portion; a fuel container for containing a fuel; an electromagnetic valve device for injecting the fuel into the combustion portion; and a grip portion. A distance from the fuel container to the combustion portion is set substantially equal to or less than a distance from the electromagnetic valve device (24) to the combustion portion.

5 Claims, 16 Drawing Sheets

GAS COMBUSTION TYPE DRIVING TOOL

BACKGROUND OF THE INVENTION

1. Field of the Invention

The present invention relates to a gas combustion type driving tool.

2. Related Art

As gas combustion type driving tools, there is known a type of a driving tool in which a fuel container such as a gas can filled with liquefied fuel gas is mounted in the tool, and the fuel supplied from the fuel container is measured by an electromagnetic valve device and then injected into a combustion portion.

In such gas combustion type driving tool, in many cases, the electromagnetic valve device is disposed near the combustion portion and the fuel container is disposed near a grip.

However, when the electromagnetic valve device is disposed nearer to the combustion portion than the fuel container, since the electromagnetic valve device is easier to be influenced by a heat of the combustion portion, a temperature of the electromagnetic valve device becomes higher than that of the fuel container.

In the case that the electromagnetic valve device becomes higher in temperature than the fuel container, when a liquefied gas is supplied from the fuel container to the electromagnetic valve device, the liquefied gas is vaporized within a gas pipe line due to the temperature difference between the fuel container and electromagnetic valve device, resulting in a poor fuel combustion to thereby prevent the driving tool against proper operation.

To avoid such problem, the temperature of the fuel container must be set substantially equal to or higher than that of the electromagnetic valve device.

For example, in a gas combustion type driving tool disclosed in U.S. Pat. No. 5,263,439, an electromagnetic valve device and a fuel container are disposed at equal distance from a combustion portion. When amounts of heat transmission from the combustion portion to the fuel container and electromagnetic valve device are equal, their respective influences can be made almost equal, thereby being able to control the temperature difference between the fuel container and electromagnetic valve device.

However, in the gas combustion type driving tool disclosed in U.S. Pat. No. 5,263,439, since the fuel container is interposed between the combustion portion and a grip portion, a grip must be disposed shifted backward by an amount equivalent to a size of the fuel container. Therefore, a position of a trigger must also be shifted backward, which worsens a balance of the whole driving tool.

SUMMARY OF THE INVENTION

One or more embodiments and modifications thereof provide a gas combustion type driving tool which can control a temperature difference between a fuel container and an electromagnetic valve device to thereby prevent poor ignition, and can be designed without shifting a grip backward to thereby enhance a gravity balance of the driving tool.

BRIEF DESCRIPTION OF THE DRAWINGS

FIG. 7(*b*) is a perspective view of the back side thereof.

DETAILED DESCRIPTION OF THE EMBODIMENTS

Figure 1:
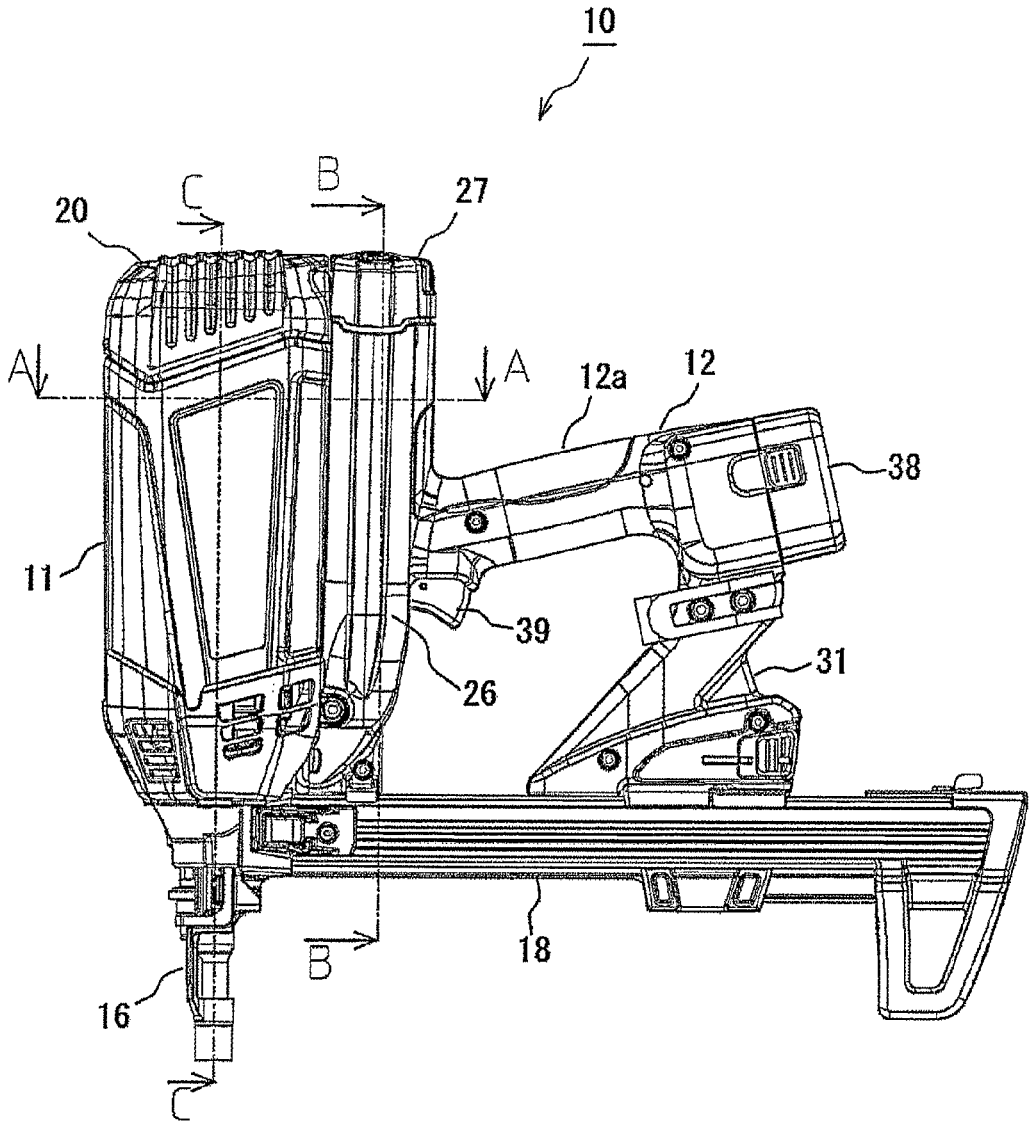
FIG. 1 is a side view of a gas combustion type driving tool.

Description will be given below of an embodiment of the invention and modifications thereof with reference to the accompanying drawings.

The embodiment and the modifications described herein are not intended to limit the invention but only to exemplify the invention, and all features or combinations of the features of the embodiment and the modifications are not always essential to the invention.

As shown in FIGS. 1 to 4, in a gas combustion type driving tool 10 according to this embodiment, a grip housing 12 is disposed backwardly of a body housing 11 storing a cylinder 13 therein, while a striking piston 15 is slidably stored in the cylinder 13. A driver 14 for driving a nail is connected to the lower surface side of the striking piston 15.

On the lower portion of the body housing 11, there is mounted a nose portion 16 for driving and guiding the nail toward a driven member, while the driver 14 connected to the striking piston 15 is slidably stored in and can be guided by the nose portion 16. A magazine 18 storing a large number of nails therein is disposed laterally of the nose portion 16. When the nails within the magazine 18 are sequentially supplied to the nose portion 16 and are then driven by the driver 14, the nails can be driven out from an injection port 17 formed in the leading end of the nose portion 16 into the driven member.

Upwardly of the cylinder 13, there is formed a combustion chamber 19 where a mixed gas constituted of a flammable gas and the air can be generated and also which serves as a combustion portion for combusting the mixed gas. This combustion chamber 19 is formed by disposing a movable sleeve 22 so as to be slidable with respect to the cylinder 13. Specifically, multiple openings formed in the upper portion of the side surface of the cylinder 13 are covered with an annular movable sleeve 22 to thereby form within the movable sleeve 22 a closed space communicating with the interior of the cylinder 13, and this closed space is used to form the combustion portion 19. Here, when the nose portion 16 is pressed against the driven member, the movable sleeve 22 can be slid upwardly to thereby close the combustion chamber 19.

Within the combustion chamber 19, the flammable gas and the air are mixed to generate the mixed gas. After this mixed gas is burned to generate a combusting gas, when the pressure of the combusting gas is applied to the striking piston 15, the striking piston 15 can be driven up to a bumper 23 disposed at a bottom dead center portion within the cylinder 13.

In a cylinder head 21 for covering the upper end of the cylinder 13, there is formed a supply port (not shown) which faces the interior of the combustion chamber 19 and is used to supply the flammable gas into the combustion chamber 19. A gas supply pipe is connected to this supply port, whereby a gas fuel injected from an electromagnetic valve device 24 can be guided to the combustion chamber 19.

The electromagnetic valve device 24 is used to supply the gas fuel to the combustion chamber 19 and includes an electromagnetic valve for controlling the supply amount of the gas fuel. This electromagnetic valve device 24 is connected to a fuel container 25. Thus, while measuring the fuel supplied from the fuel container 25, it can inject a given amount of flammable gas into the combustion chamber 19.

As the flammable gas is injected into the combustion chamber 19 by the electromagnetic valve device 24, a rotary fan 35 provided on the cylinder head 21 is rotated, whereby the flammable gas supplied into the combustion chamber 19 is mixed with the air existing within the combustion chamber 19 to thereby generate a mixed gas having a given air-fuel ratio.

Also, on the cylinder head 21, there is provided an ignition device (not shown) used to ignite the mixed gas generated within the combustion chamber 19 for combustion. This ignition device is constituted of an ordinary ignition plug which can raise the voltage of a battery 38 mounted on the rear end portion of a grip portion 12*a* up to a high voltage and can discharge this high voltage to thereby generate sparks. This ignition device can be actuated when a trigger 39 provided on the base portion of the grip portion 12*a* is operated. When the ignition device is actuated and the sparks are generated within the combustion chamber 19, a combustion gas of a high pressure is generated within the combustion chamber 19 and the impact of the combustion gas causes the striking piston 15 to slide in an axis of the combustion portion 19, thereby driving a nail.

Here, the grip portion 12*a*, as shown in FIG. 1 and so on, extends in a direction substantially perpendicular to the axial direction of the combustion chamber 19 and thus, by gripping this grip portion 12*a*, an operator is able to hold the gas combustion type driving tool 10 stably.

Figure 2:
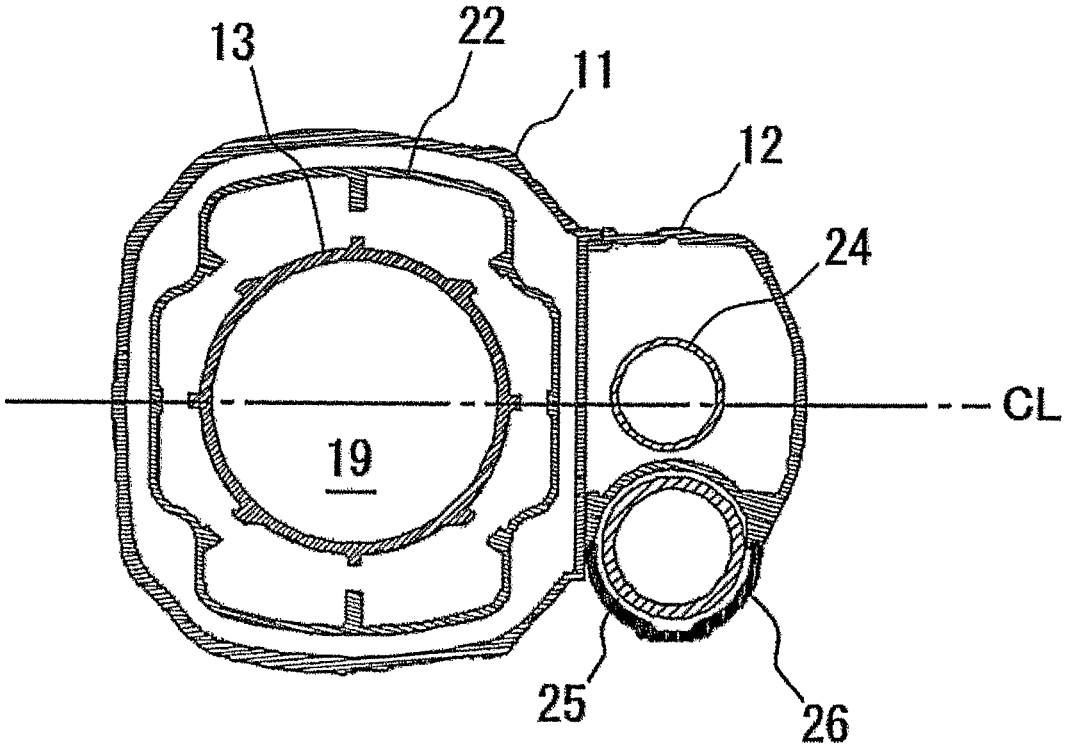
FIG. 2 is a transverse section view (A-A section view) of the gas combustion type driving tool.
Figure 3:
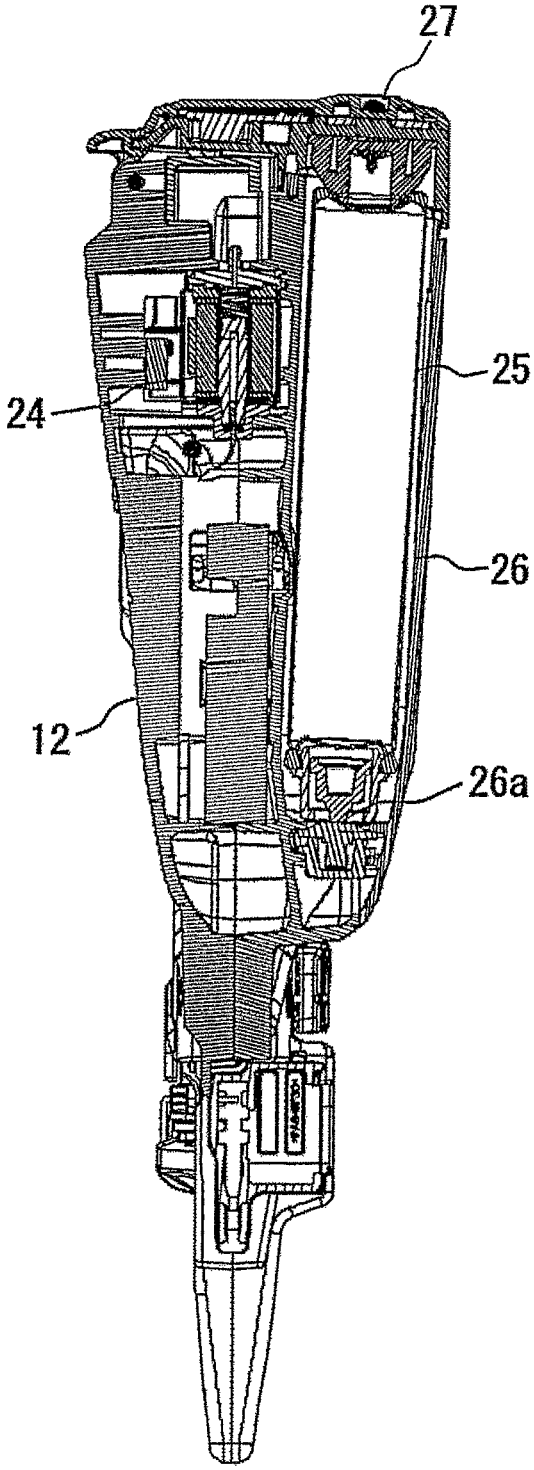
FIG. 3 is a longitudinal section view (B-B section view) of the gas combustion type driving tool.
Figure 4:
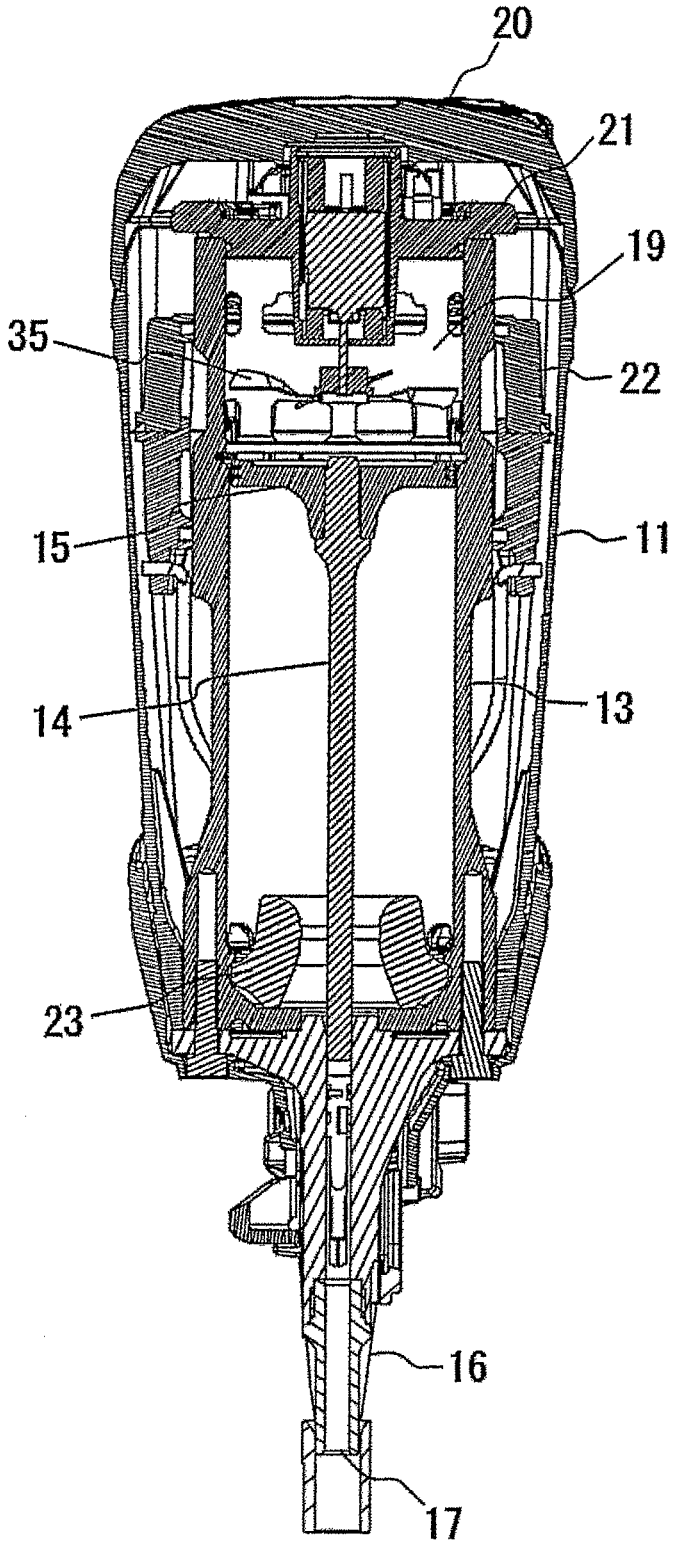
FIG. 4 is a longitudinal section view (C-C section view) of the gas combustion type driving tool.
Figure 5:
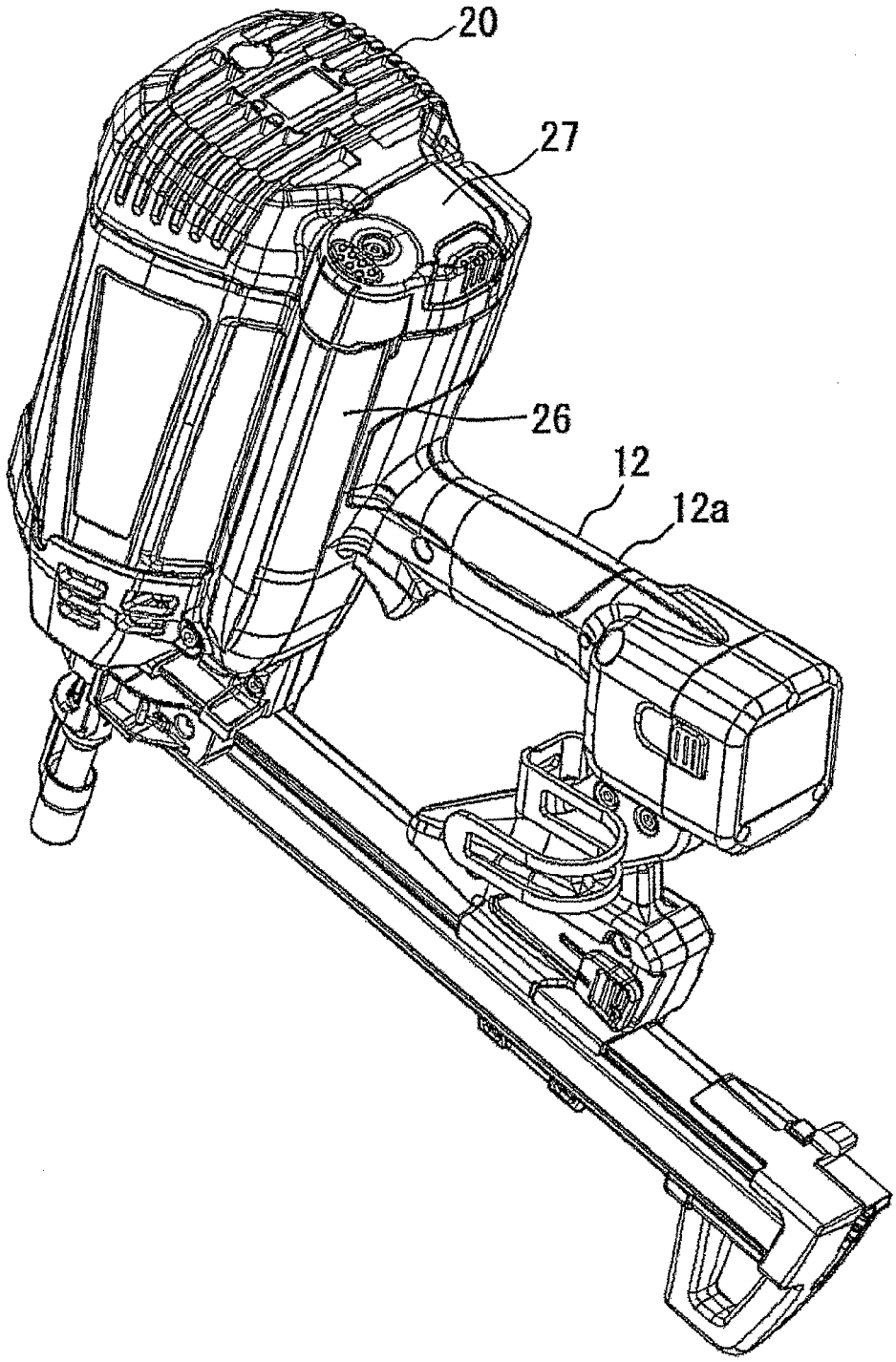
FIG. 5 is an external view of the gas combustion type driving tool when viewed obliquely backward, showing a state where its storage cover portion is closed.

Also, the fuel container 25 of this embodiment, as shown in FIGS. 2 and 3, is formed to have a tubular shape (a cylindrical shape). This tubular fuel container 25, as shown in FIG. 2, is disposed on the outer peripheral portion of the combustion chamber 19 such that it extends substantially parallel to the axis of the combustion chamber 19. Thus, the fuel container 25 is disposed along the combustion chamber 19 as closely to the combustion chamber 19 as possible.

The tubular fuel container 25, as shown in FIG. 2, is situated at a position shifted from the axial extension line CL of the grip portion 12*a* in such a manner that it adjoins the side portion of the front end of the grip portion 12*a*. In this case, since a line connecting the combustion chamber 19 and grip portion 12*a* with the shortest distance exists on the axial extension line CL of the grip portion 12*a*, inevitably, the fuel container 25 is so disposed as to avoid a line which extends along the outer peripheral portion of the combustion portion 19 and connects the combustion chamber 19 and grip portion 12*a* with the shortest distance. That is, the fuel container 25 is disposed not between the combustion chamber 19 and grip portion 12*a* but in the base section of the grip portion 12*a* shifted from the extension direction of the grip portion 12*a*. More specifically, the fuel container 25 is disposed nearer to the grip portion 12*a* than the combustion chamber 19 and, as shown in FIG. 2, is disposed such that it does not project with respect to the lateral width of the body housing 11.

Here, the electromagnetic valve device 24 as well, as shown in FIG. 2, is disposed on the outer peripheral portion of the combustion chamber 19 substantially parallel to the axis of the combustion chamber 19. In this case, the distance from the electromagnetic valve device 24 to the combustion chamber 19 is set substantially equal to the distance from the combusting container 25 to the combustion chamber 19.

The fuel container 25 is stored in a fuel container storing portion 26 formed within the grip housing 12. The fuel container storing portion 26, as shown in FIG. 3, includes in the deep portion thereof a connecting section 26*a* for connection of the fuel container 25. This connection section 26*a* communicates with the electromagnetic valve device 24 through a gas pipe and, when the fuel container 25 is connected to this connection section 26*a*, the fuel within the fuel container 25 can be supplied to the electromagnetic valve device 24.

Figure 6:
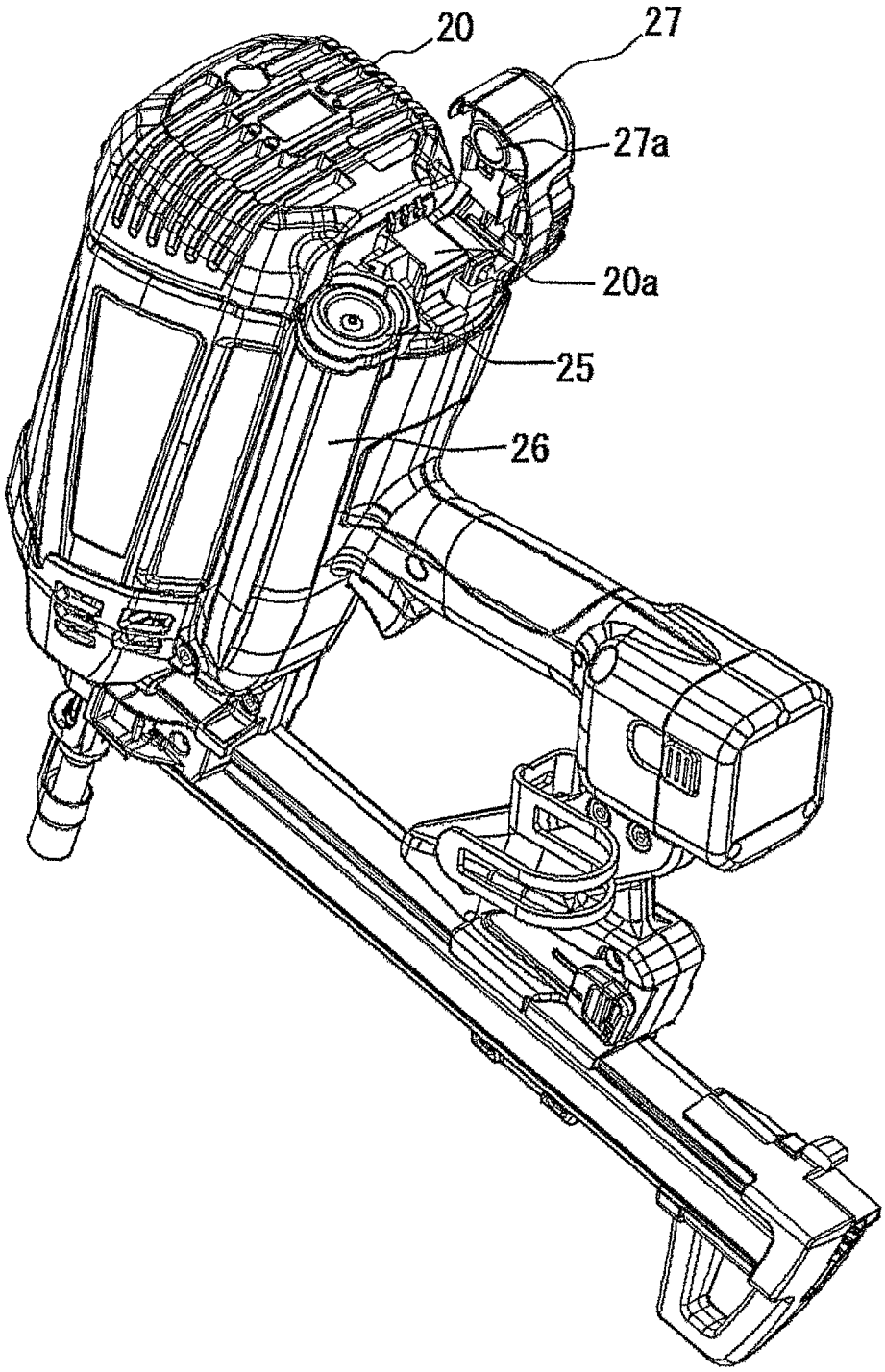
FIG. 6 is an external view of the gas combustion type driving tool when viewed obliquely backward, showing a state where the storage cover portion is closed.

On the fuel container storing portion 26, specifically, on the opposite end thereof to the connecting section 26, there is mounted a storage cover portion 27 used to openably close the fuel container storing portion 26. This storage cover portion 27 is rotatably supported on the grip housing 12 through a hinge. When the storage cover portion 27 is opened, as shown in FIG. 6, the upper surface of the fuel container storing portion 26 is opened, whereby the fuel container 25 stored within the fuel container storing portion 26 can be taken out or the fuel container 25 can be inserted into the fuel container storing portion 26.

Figure 7A:
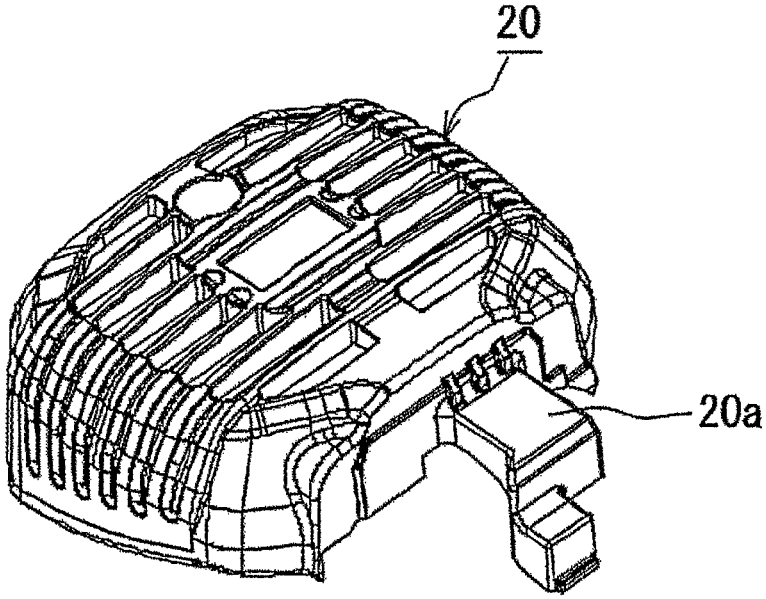
FIG. 7(*a*) is a perspective view of the front side of a cylinder cap.
Figure 7B:
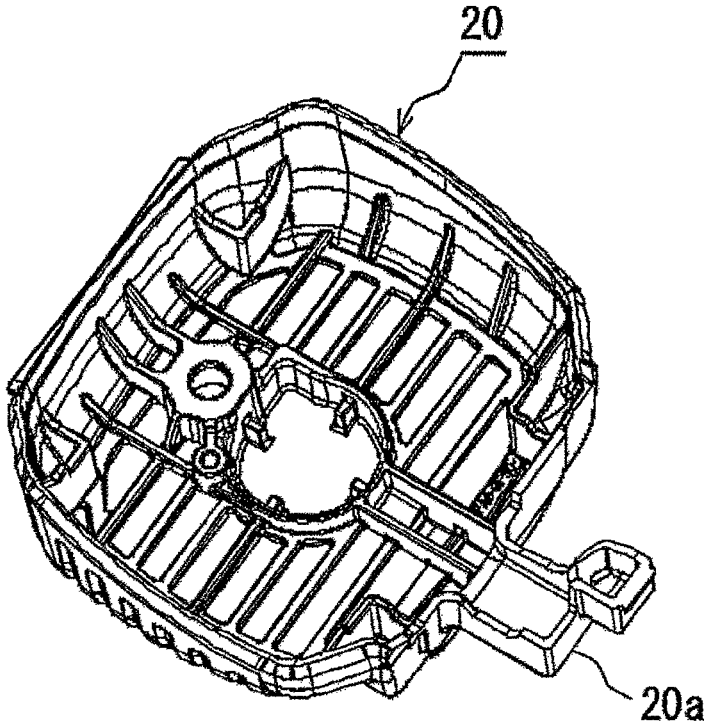
Figure 8:
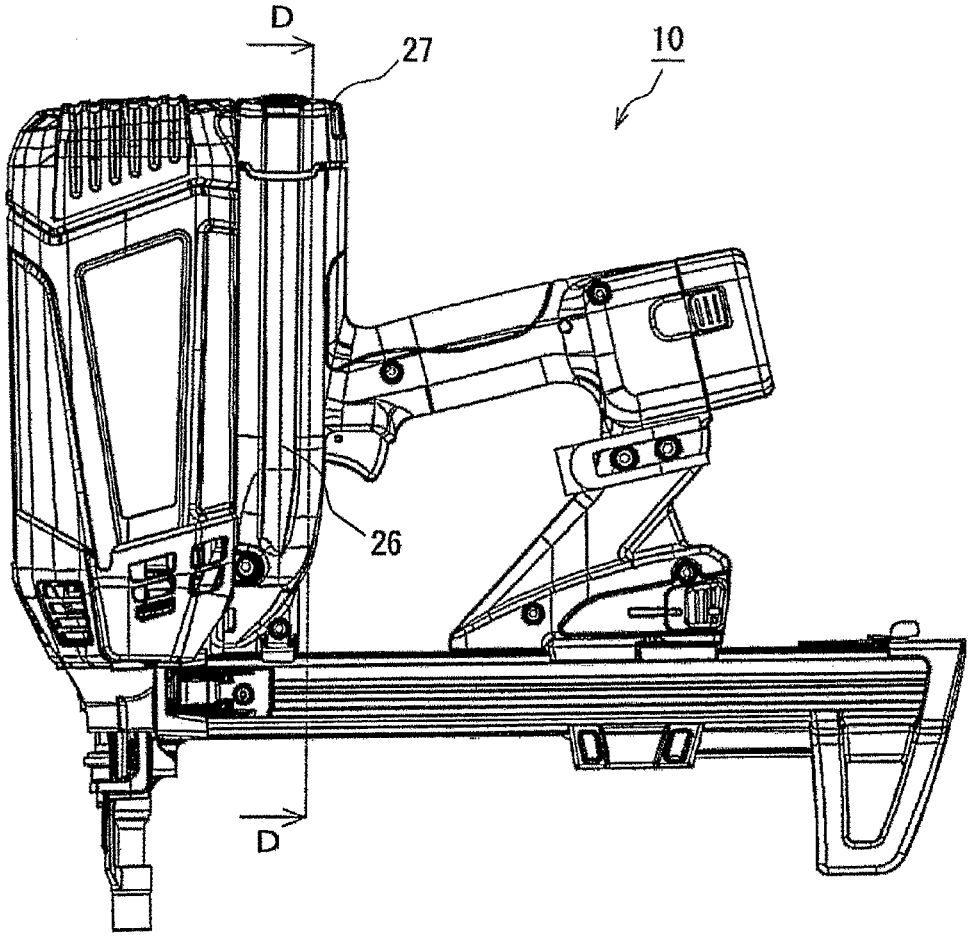
FIG. 8 is a side view of the gas combustion type driving tool.

In this embodiment, when the storage cover portion 27 is opened, a cylinder cap 20 covers the wiring of the interior portion of the grip housing 12 to prevent it against exposure. That is, as shown in FIGS. 7(*a*) and 7(*b*), the cylinder cap 20 includes, on its grip portion 12*a* side portion, an extension portion 20*a* projected integrally therefrom, whereby this extension portion 20*a* covers the wiring of the interior portion of the grip housing 12 to prevent it against exposure (see FIG. 6).

Also, a pressure member 27*a* made of high polymer material such as rubber is fixed to the back surface of the storage cover portion 27. This pressure member 27*a*, when the storage cover portion 27 is closed, can be contacted with the fuel container 25 to press it in the direction of the connecting section 26*a*. Here, although the pressure member 27*a* may also be replaced with a metal-made spring or the like, an elastic member made of high polymer material can absorb impacts faster and thus can prevent a gas can or the like against damage when absorbing the impacts.

Figure 9:
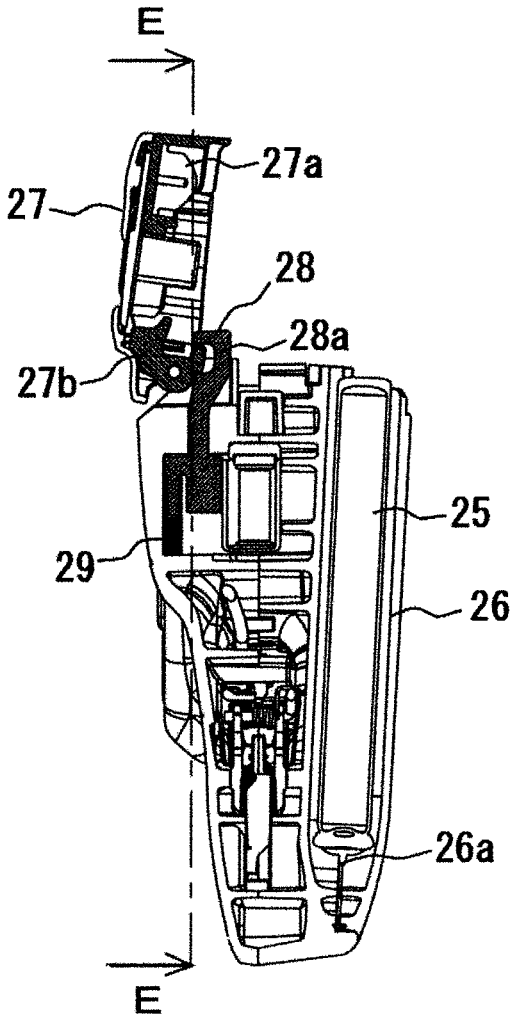
FIG. 9 is a longitudinal section view (D-D section view) of the gas combustion type driving tool, showing a state where a storage cover portion is closed.
Figure 10:
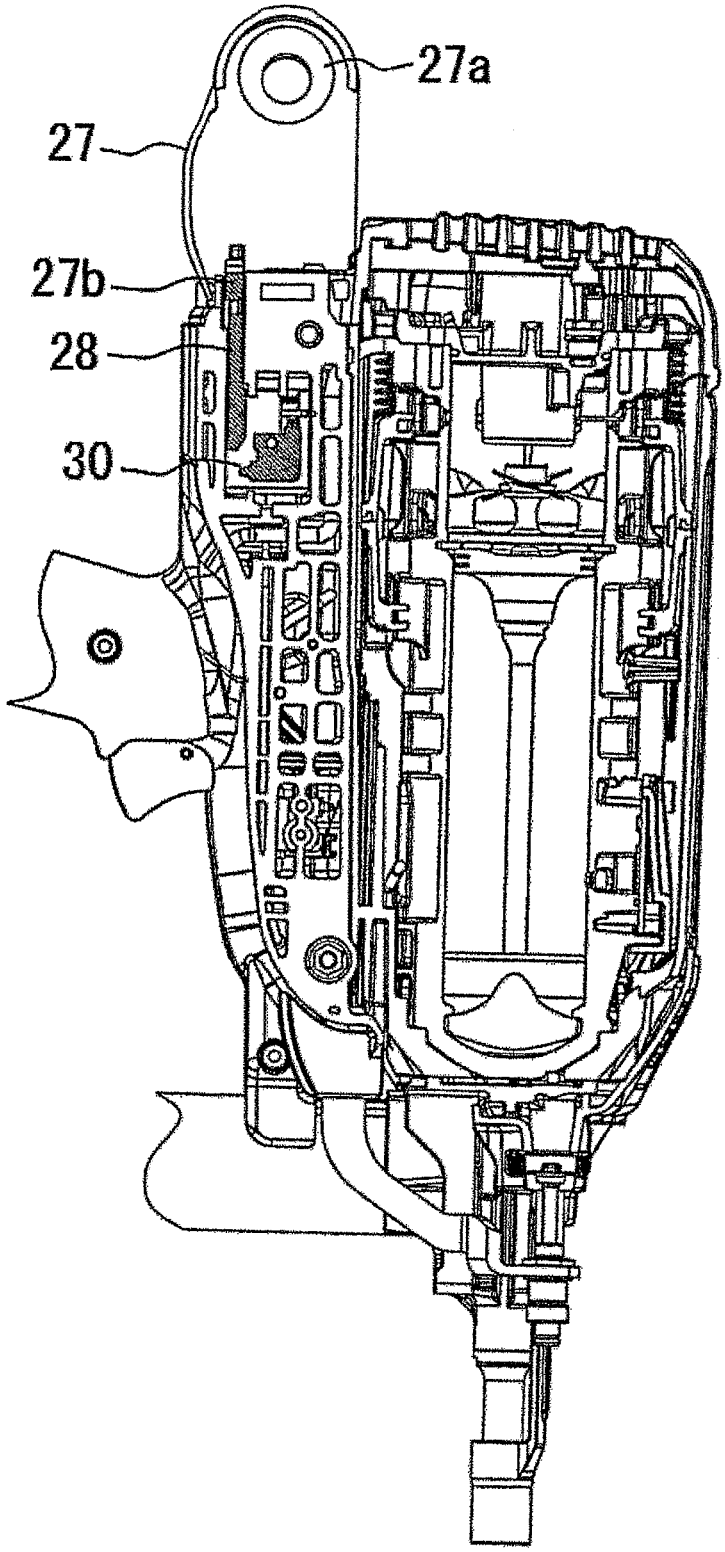
FIG. 10 is a longitudinal section view (E-E section view) of the gas combustion type driving tool, showing a state where the storage cover portion is opened.

Since the opened or closed state of the storage cover portion 27 can be detected by a micro switch 30, the replacement of the fuel container 25 can be carried out safely. FIG. 9 is a section view of the driving tool 10, showing the opened state of the storage cover portion 27. As shown in FIG. 9, when the storage cover portion 27 is opened, an engaging portion 27*b* formed in the back surface of the storage cover portion 27 is engaged with the engaged portion 28*a* of a slide member 28 stored slidably within the grip housing 12 to thereby raise the slide member 28 upwardly. The energizing force of a spring 29 increases the raising force to slide the slide member 28 in a direction where it projects upwardly. In this case, as shown in FIG. 10, the end portion of the slide member 28 is separated from the micro switch 30.

Figure 11:
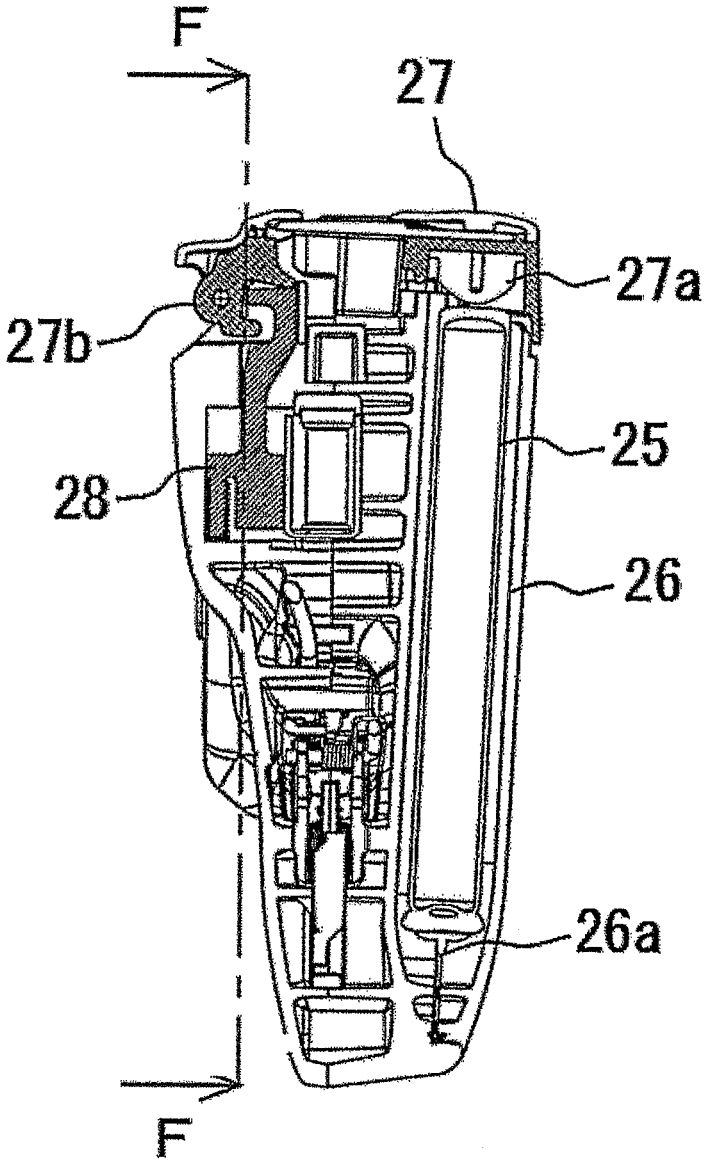
FIG. 11 is a longitudinal section view (D-D section view) of the gas combustion type driving tool, showing a state where the storage cover portion is closed.
Figure 12:
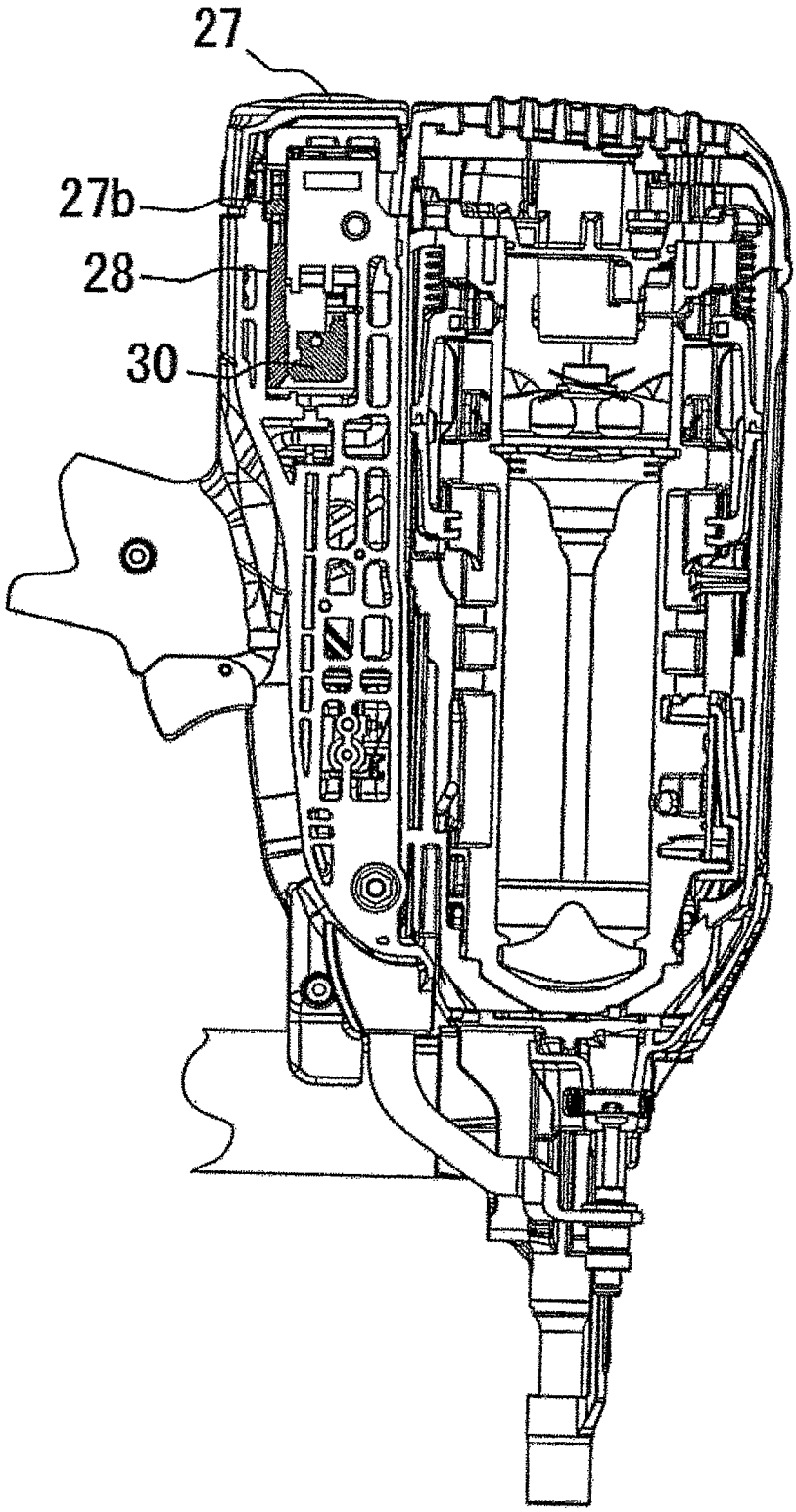
FIG. 12 is a longitudinal section view (F-F section view) of the gas combustion type driving tool, showing a state where the storage cover portion is closed.

When the storage cover portion 27 is closed, as shown in FIG. 11, the engaging portion 27*b* is engaged with the engaged portion 28*a*, thereby pressing the slide member 28 downwardly. Accordingly, as shown in FIG. 12, the end portion of the slide member 28 is contacted with the micro switch 30 to press down the micro switch 30. That is, since a control device (not shown) is used to detect the depressing signal of the micro switch 30, the opened or closed state of the storage cover portion 27 can be detected.

As described above, in this embodiment, the tubular fuel container 25 is disposed on the outer peripheral portion of the combustion chamber 19 substantially parallel to the combustion chamber 19. Therefore, since the fuel container 25 can be disposed along the combustion chamber 19 as near to the combustion chamber 19 as possible, the temperature difference between the fuel container 25 and electromagnetic valve device 24 can be reduced. This can prevent the fuel from vaporizing within the gas pipe line extending from the fuel container 25 to the electromagnetic valve device 24 and thus the fuel flow amount control by the electromagnetic valve device 24 can be carried out properly. That is, poor ignition can be prevented, thereby being able to enhance the reliability of the driving tool 10.

Moreover, the tubular fuel container 25 is disposed such that it avoids the line connecting the combustion chamber 19 and grip portion 12*a* with the shortest distance. That is, since the fuel container 25 is situated at a position shifted from the extension direction of the grip portion 12*a*, the influence of the grip portion 12*a* on the layout of the driving tool 10 can be reduced. Therefore, the driving tool 10 can be laid out without pressing down the grip portion 12*a* backwardly, which can enhance the gravity balance of the driving tool 10.

Also, the distance from the fuel container 25 to the combustion chamber 19 is set not to exceed the distance from the electromagnetic valve device 24 to the combustion chamber 19. (Specifically, a distance from a wall of the body housing 11 where the body housing 11 (which acts as an outer surface of the combustion chamber 19) and the grip housing 12 intersects to an outer surface of the fuel container 25 does not exceed a distance from said wall of the body housing 11 to an outer surface of the electromagnetic valve device 24.) In this case, the fuel container 25 can be formed such that it can be influenced more greatly by the heat of the combustion chamber 19 than the electromagnetic valve device 24, thereby being able to prevent the fuel from vaporizing within the gas pipe line extending from the fuel container 25 to the electromagnetic valve device 24.

The fuel container 25 is disposed adjacent to the front end side portion of the grip portion 12*a*. That is, since the fuel container 25 is disposed in the base portion of the grip portion 12*a*, the gravity balance of the driving tool 10 can be enhanced.

The fuel container 25 is disposed nearer to the grip portion 12*a* than the combustion chamber 19. Thus, since the fuel container 25 does not project laterally or forwardly of the combustion chamber 19, the driving tool 10 can be formed compact.

Figure 13:
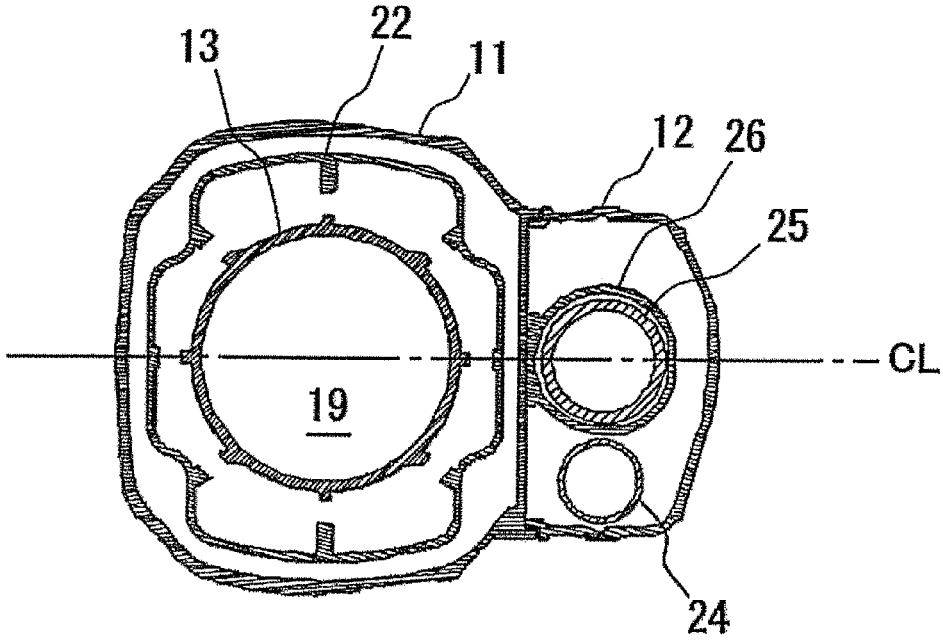
FIG. 13 is a view of a modification of the embodiment, where the electromagnetic valve device and fuel container are disposed differently from the embodiment.

The fuel container 25, as shown in FIG. 13, may also be disposed on the outer peripheral portion of the combustion chamber 19 substantially parallel to the axis of the combustion chamber 19 and at a position existing on the axial extension line of the grip portion 12*a*. In this case, when the electromagnetic valve device 24 is also disposed on the outer peripheral portion of the combustion chamber 19, since the distance from the combusting container 25 to the combustion chamber 19 can be easily set substantially equal to or less than the distance from the electromagnetic valve device 24 to the combustion chamber 19 (specifically, a distance from a wall of the body housing 11 where the body housing 11 (which acts as an outer surface of the combustion chamber 19) and the grip housing 12 intersects to an outer surface of the fuel container 25 does not exceed a distance from said wall of the body housing 11 to an outer surface of the electromagnetic valve device 24), the fuel can be prevented from vaporizing within the gas pipe line extending from the fuel container 25 to the electromagnetic valve device 24 and the flow rate of the fuel can be controlled properly by the electromagnetic valve device 24. That is, poor ignition can be prevented and thus the reliability of the driving tool 10 can be enhanced. Also, since the fuel container 25 and electromagnetic valve device 24 can be disposed within the grip housing 12 on the base portion side of the grip portion 12*a*, the whole of the driving tool 10 can be formed compact.

In the above embodiment, the fuel container 25 and electromagnetic valve device 24 are respectively disposed on the outer peripheral portion of the combustion chamber 19 substantially parallel to the axis of the combustion chamber 19. However, the layout of the driving tool 10 with the distance from the combusting container 25 to the combustion chamber 19 set less than the distance from the electromagnetic valve device 24 to the combustion chamber 19 may also be carried out in other various embodiments.

Figure 14A:
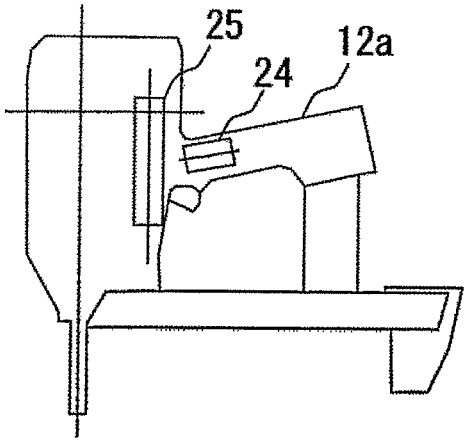
FIGS. 14(*a*) to 14(*c*) are views of the modification of the embodiment, showing its first arrangement example (an example 1) of the electromagnetic valve device and fuel container.
Figure 14B:
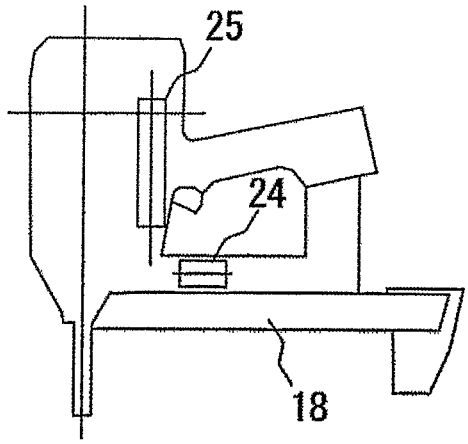
Figure 14C:
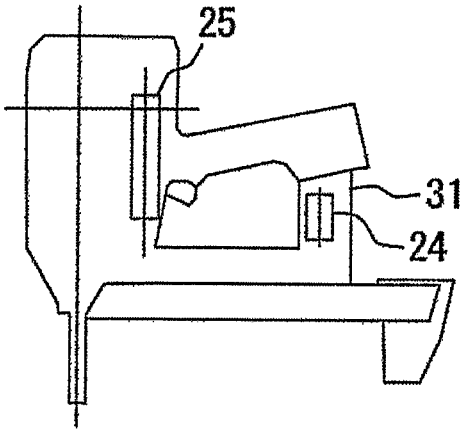
Figure 15A:
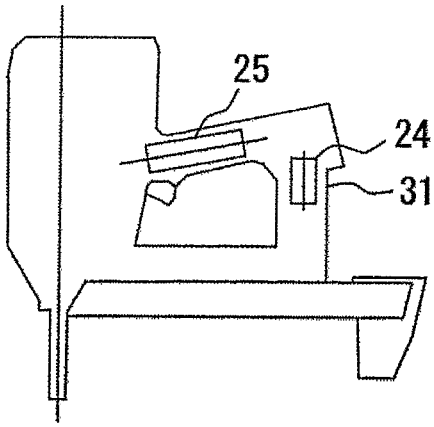
FIGS. 15(*a*) to 15(*d*) are views of the modification of the embodiment, showing its second arrangement example (an example 2) of the electromagnetic valve device and fuel container.
Figure 15B:
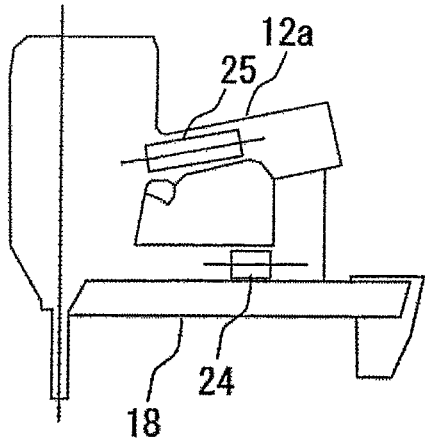
Figure 15C:
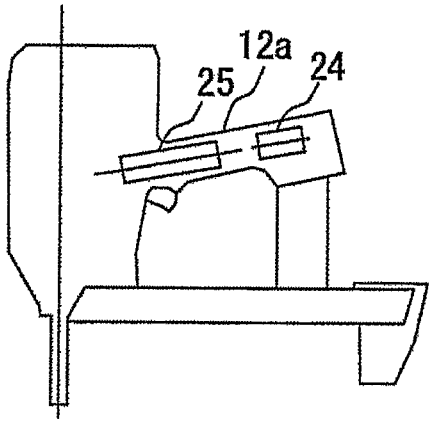
Figure 15D:
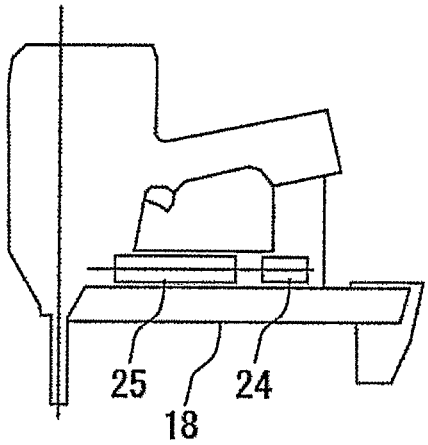
Figure 16A:
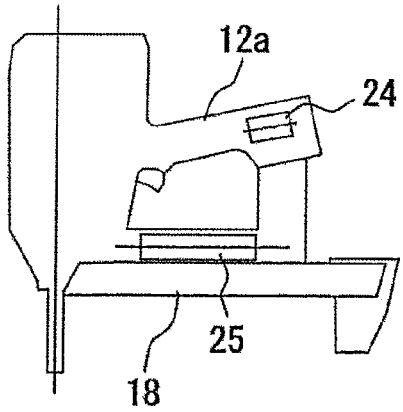
FIGS. 16(*a*) to 16(*e*) are views of the modification of the embodiment, showing its third arrangement example (an example 3) of the electromagnetic valve device and fuel container.
Figure 16B:
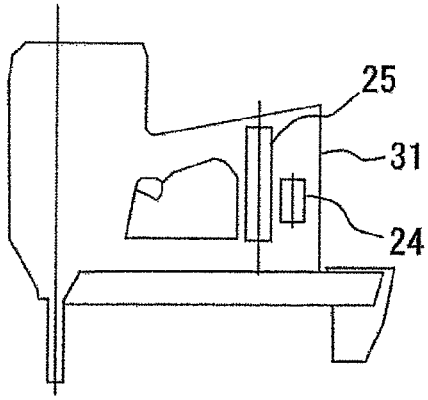
Figure 16C:
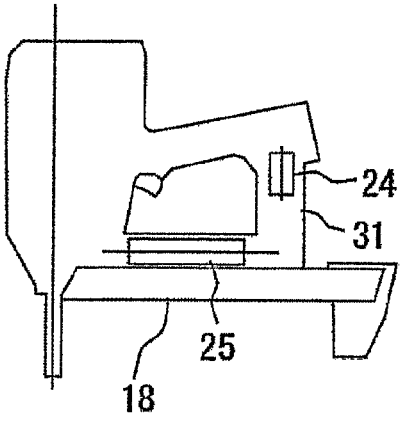
Figure 16D:
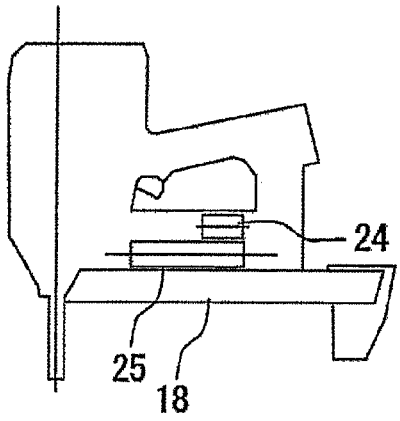
Figure 16E:
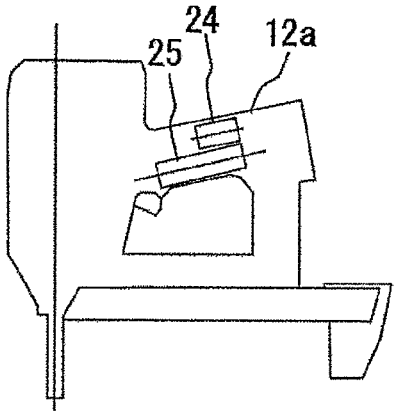

For example, as shown in FIGS. 14(*a*) to 14(*c*), while the fuel container 25, similarly to the above embodiment, is disposed on the outer peripheral portion of the combustion chamber 19 substantially parallel to the axis of the combustion chamber 19, the position of the electromagnetic valve device 24 may be changed. For example, as shown in FIG. 14(*a*), the electromagnetic valve device 24 may also be disposed within the grip portion 12*a*. Also, as shown in FIG. 14(*b*), the electromagnetic valve device 24 may also be disposed along the magazine 18. Further, as shown in FIG. 14(*c*), the electromagnetic valve device 24 may also be disposed in a bridge portion 31 connecting the rear end of the grip portion 12*a* and the rear end of the magazine 18.

As shown in FIGS. 15(*a*) to 15(*d*), and in FIGS. 16(*a*) to 16(*e*), the position of the fuel container 25 may also be changed.

That is, as shown in FIG. 15(*a*), the fuel container 25 may be disposed within the grip portion 12*a* and the electromagnetic valve device 24 may be disposed within the bridge portion 31. Also, as shown in FIG. 15(*b*), the fuel container 25 may be disposed within the grip portion 12*a* and the electromagnetic valve device 24 may be disposed along the magazine 18. And, as shown in FIG. 15(*c*), the fuel container 25 may be disposed within the grip portion 12*a* and the electromagnetic valve device 24 may be disposed backwardly of the fuel container 25 within the grip portion 12*a*. Also, as shown in FIG. 15(*d*), the fuel container 25 may be disposed along the magazine 18 and the electromagnetic valve device 24 may be disposed backwardly of the fuel container 25.

As shown in FIG. 16(*a*), the fuel container 25 maybe disposed along the magazine 18 and the electromagnetic valve device 24 maybe disposed within the grip portion 12*a*. Also, as shown in FIG. 16(*b*), the fuel container 25 may be disposed within the bridge portion 31 and the electromagnetic valve device 24 may be disposed backwardly of the fuel container 25 within the bride portion 31. And, as shown in FIG. 16(*c*), the fuel container 25 may be disposed along the magazine 18 and the electromagnetic valve device 24 may be disposed within the bride portion 31. Also, as shown in FIG. 16(*d*), the fuel container 25 may be disposed along the magazine 18 and the electromagnetic valve device 24 maybe disposed near the rear end of the fuel container 25. And, as shown in FIG. 16(*e*), the fuel container 25 may be disposed within the grip portion 12*a* and the electromagnetic valve device 24 may be disposed near the rear end of the fuel container 25.

In accordance with the above embodiment and modifications (examples) thereof, a gas combustion type driving tool may include: a combustion portion 19; a tubular fuel container 25 filled with a fuel to be supplied to the combustion portion 19; an electromagnetic valve device 24 adapted to measure the fuel supplied from the fuel container 25 and to inject the fuel into the combustion portion 19; and a grip portion 12*a*. The fuel container 25 maybe disposed not on a line connecting the combustion portion 19 and the grip portion 12*a* with the shortest distance. A distance from the fuel container 25 to the combustion portion 19 is set substantially equal to or less than a distance from the electromagnetic valve device 24 to the combustion portion 19.

Further, the words "substantially equal" means that there is no substantive difference between a thermal effect of the combustion portion 19 to the fuel container 25 and a thermal effect of the combustion portion 19 to the electromagnetic valve device 24. Specifically, when a difference between the distance from the fuel container 25 to the combustion portion 19 and the distance from the electromagnetic valve device 24 to the combustion portion 19 is within a range of 20 mm to 30 mm, the difference should be considered as being within a scope of the "substantially equal".

According to the above structure, the tubular fuel container 25 is disposed such that the distance from the fuel container 25 to the combustion portion 19 is set substantially equal to or less than the distance from the electromagnetic valve device 24 to the combustion portion 19. Due to this configuration, the fuel container 25 can receive lager thermal effect from the combustion portion 19 than the electromagnetic valve device 24. Thereby, a vaporization of the fuel within the gas pipe line between the fuel container 25 to the electromagnetic valve device 24 can be prevented, so that a flow amount control of the electromagnetic valve device 24 can be accurately carried out. That is, the poor ignition can be prevented, and a reliability of the tool can be enhanced.

Moreover, according to the above structure, the tubular fuel container 25 is disposed on a portion other than the line connecting the combustion portion 19 and the grip portion 12*a* with the shortest distance. That is, the fuel container 25 is disposed in a position deviated from an extending line of the grip portion 12*a*. Accordingly, an affect to a layout of the grip portion 12*a* can be minimized. Thereby, the grip portion 12*a* can be laid out without shifting backward, and the gravity balance of the tool can be enhanced.

In the above structure, the fuel container 25 maybe disposed substantially parallel to an axis of the combustion portion 19.

According to this structure, when the fuel container 25 is disposed in the outer peripheral portion of the combustion portion 19, the fuel container 25 can be arranged in compact along the combustion portion 19.

In the above structure, the fuel container 25 maybe disposed on an outer peripheral portion of the combustion portion 19.

According to this structure, since the fuel container 25 can be arranged along the combustion portion 19 as near as possible to the combustion portion 19, a difference between temperatures of the fuel container 25 and the electromagnetic valve device can be suppressed. Thereby, the vaporization of the fuel within the gas pipe line between the fuel container 25 to the electromagnetic valve device 24 can be prevented.

In the above structure, the fuel container 25 maybe disposed adjacent to a side portion of a front end of the grip portion 12*a*.

According to this structure, since the fuel container 25 is positioned at a base part of the grip portion 12*a*, the gravity balance of the tool can be enhanced.

In the above structure, the fuel container 25 maybe disposed nearer to the grip portion 12*a* than the combustion portion 19.

According to this structure, since the fuel container 25 does not protrude sideward or frontward of the combustion portion 19, the tool can be compact.

In addition, in accordance with the above embodiment and modifications (examples), a gas combustion type driving tool may include: a combustion portion 19; a tubular fuel container 25 filled with a fuel to be supplied to the combustion portion 19; an electromagnetic valve device 24 adapted to measure the fuel supplied from the fuel container 25 and to inject the fuel into the combustion portion 19; and a grip portion 12*a*. The fuel container 25 and the electromagnetic valve device 24 may be respectively disposed on an outer peripheral portion of the combustion portion 19. The fuel container 25 may be disposed at a position on an axial extension line CL of the grip portion 12*a* so as to be parallel to an axis of the combustion portion 19. A distance from the fuel container 25 to the combustion portion 19 may be set substantially equal to or less than a distance from the electromagnetic valve device 24 to the combustion portion 19.

According to this structure, since the fuel container 25 can be arranged along the combustion portion 19 as near as possible to the combustion portion 19, a difference between temperatures of the fuel container 25 and the electromagnetic valve device can be suppressed. Thereby, the vaporization of the fuel within the gas pipe line between the fuel container 25 to the electromagnetic valve device 24 can be prevented.

In addition, according to this structure, the fuel container 25 is disposed at the position on the axial extension line CL of the grip portion 12*a* so as to be parallel to the axis of the combustion portion 19. Accordingly, since the fuel container 25 can be disposed within a grip housing at a base side of the grip portion 12*a*, the tool can be compact.

DESCRIPTION OF REFERENCE NUMERALS AND SIGNS

10: Gas combustion type driving tool
11: Body housing
12: Grip housing
12*a*: Grip portion
13: Cylinder
14: Driver
15: Striking piston
16: Nose portion

17: Injection port
18: Magazine
19: Combustion chamber (Combustion Portion)
20: Cylinder cap
20*a*: Extension portion
21: Cylinder head
22: Movable sleeve
23: Bumper
24: Electromagnetic valve device
25: Fuel container
26: Fuel container storing portion
26*a*: Connecting section
27: Storage cover portion
27*a*: Pressure member
27*b*: Engaging portion
28: Slide member
28*a*: Engaged portion
29: Spring
30: Micro switch
31: Bridge portion
35: Rotary fan
38: Battery
39: Trigger
CL: Axial extension line of grip portion

What is claimed is:

1. A gas combustion type driving tool comprising:

a combustion portion;

a tubular fuel container filled with a fuel to be supplied to the combustion portion;

an electromagnetic valve device adapted to measure the fuel supplied from the fuel container and to inject the fuel into the combustion portion; and a grip portion, wherein the fuel container and the electromagnetic valve device are respectively disposed on an outer peripheral portion of the combustion portion at a same cross-section perpendicular to a driving direction of the tool, wherein the fuel container is disposed not on a line connecting the combustion portion and the grip portion with the shortest distance, and wherein a distance from the fuel container to the combustion portion is set substantially equal to or less than a distance from the electromagnetic valve device to the combustion portion.

2. The gas combustion type driving tool according to claim 1, wherein the fuel container is disposed substantially parallel to an axis of the combustion portion.

3. The gas combustion type drive tool according to claim 1, wherein the fuel container is disposed adjacent to a side portion of a front end of the grip portion.

4. The gas combustion type drive tool according to claim 1, wherein the fuel container is disposed nearer to the grip portion than the combustion portion.

5. A gas combustion type driving tool comprising:

a combustion portion;

a tubular fuel container filled with a fuel to be supplied to the combustion portion;

an electromagnetic valve device adapted to measure the fuel supplied from the fuel container and to inject the fuel into the combustion portion; and a grip portion, wherein the fuel container and the electromagnetic valve device are respectively disposed on an outer peripheral portion of the combustion portion at a same cross-section perpendicular to a driving direction of the tool, wherein the fuel container is disposed at a position on an axial extension line of the grip portion so as to be parallel to an axis of the combustion portion, and a distance from the fuel container to the combustion portion is set substantially equal to or less than a distance from the electromagnetic valve device to the combustion portion.

* * * * *